US011008769B2

(12) United States Patent
Elliott

(10) Patent No.: US 11,008,769 B2
(45) Date of Patent: May 18, 2021

(54) RIGID COVER FOR SPAS AND HOT TUBS

(71) Applicant: Daniel J Elliott, Pompano Beach, FL (US)

(72) Inventor: Daniel J Elliott, Pompano Beach, FL (US)

( * ) Notice: Subject to any disclaimer, the term of this patent is extended or adjusted under 35 U.S.C. 154(b) by 0 days.

(21) Appl. No.: 16/054,425

(22) Filed: Aug. 3, 2018

(65) Prior Publication Data

US 2020/0141145 A1 May 7, 2020

(51) Int. Cl.
*E04H 4/08* (2006.01)

(52) U.S. Cl.
CPC ..... *E04H 4/08* (2013.01)

(58) Field of Classification Search
CPC ..... E04H 4/08
USPC ..... 4/498, 580, 557
See application file for complete search history.

(56) References Cited

U.S. PATENT DOCUMENTS 3,683,428 A * 8/1972 Morris ..... E04H 4/08 4/498
4,067,155 A * 1/1978 Ruff ..... E04B 1/6803 4/498
5,367,722 A 11/1994 Pesterfield
5,685,031 A 11/1997 Watkins et al.
5,974,600 A * 11/1999 Pucci ..... E04H 4/084 4/498
6,286,156 B1 * 9/2001 Sullivan ..... E04H 4/088 4/498
7,174,576 B1 2/2007 Tedrick
9,574,361 B2 * 2/2017 Dose ..... E04H 4/084

* cited by examiner

*Primary Examiner* — Tuan N Nguyen
(74) *Attorney, Agent, or Firm* — Marsh IP Law

(57) ABSTRACT

A hard cover for spas, hot tubs and the like has an outer layer defining one or more cover portions that may be hinged together along a common top edge. Each cover portion internally includes a plurality of rigid panels, which may be made of expanded polystyrene or another rigid foam or the like. A support structure that mechanically couples and/or supports the panels is provided to improve the load-bearing capacity of the spa cover, optionally providing sufficient strength to conform to applicable safety standards. The support structure can include beams having various cross-sections, or combinations thereof, and may be provided in multiple segments that are shorter than the overall length of the cover. A vapor barrier film can be provided that encloses the panels and optionally some or all portions of the support structure to protect these components from degradation in the spa environment.

20 Claims, 6 Drawing Sheets

PRIOR ART

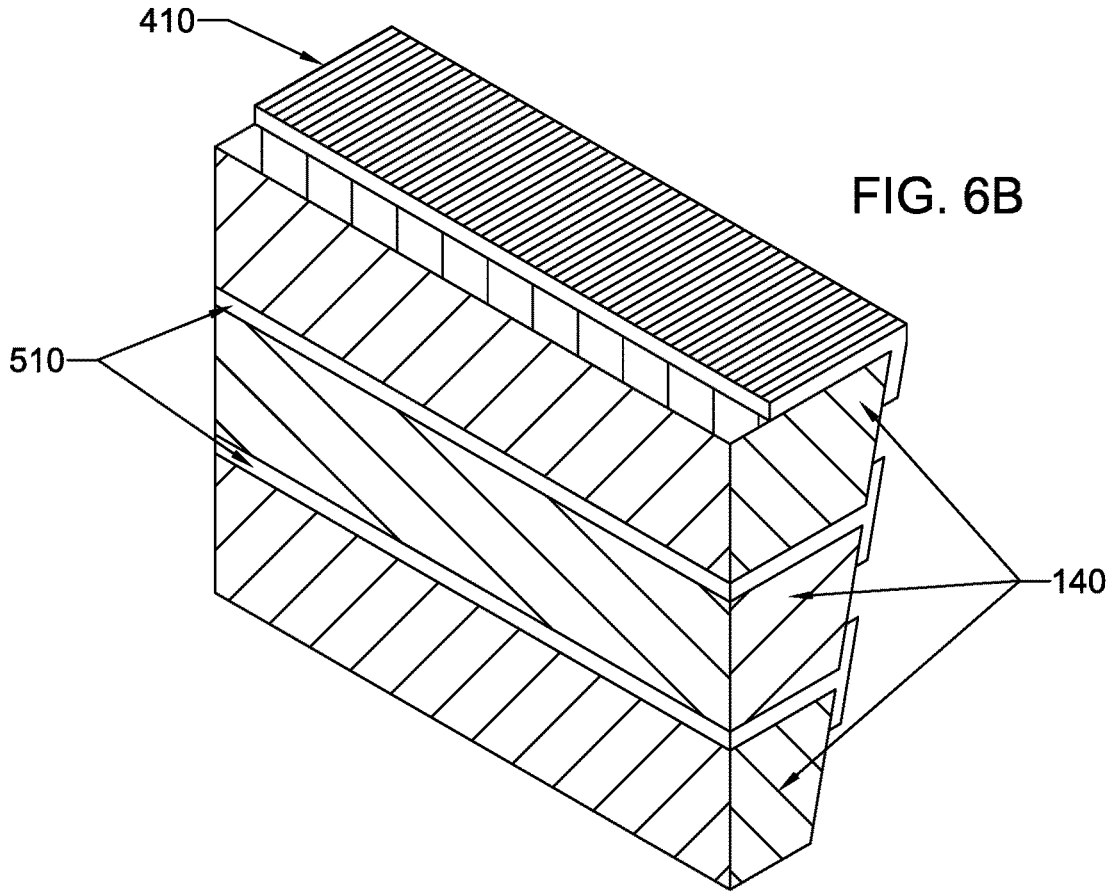
FIG. 6B
FIG. 6C
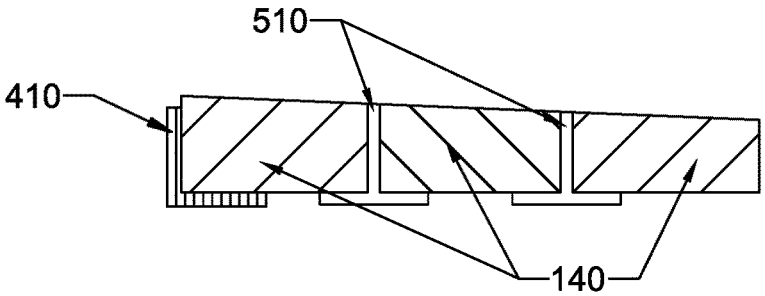
FIG. 6D
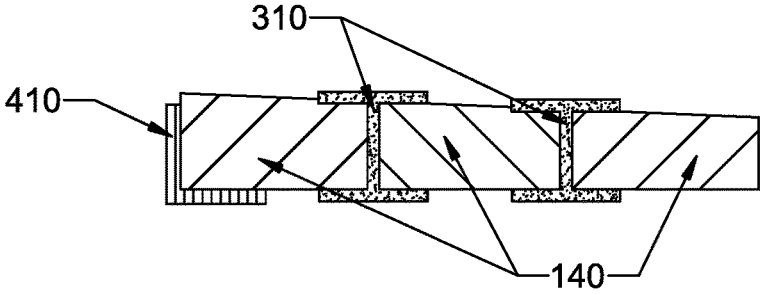

RIGID COVER FOR SPAS AND HOT TUBS

FIELD OF THE DISCLOSURE

The present invention relates to rigid or "hard" covers for spas and hot tubs and, more specifically, to such covers that include multiple panels within each pocket of an outer material and an internal support structure for the panels that together provide overall rigidity, such that the spa cover may conform to ASTM safety standards and can be more easily stored and shipped while maintaining mechanical integrity during use.

BACKGROUND INFORMATION

Spas, hot tubs and similar water tubs or pools (collectively referred to herein as "spas") have become popular over the past several decades for both recreational and health reasons. Spas are often provided with a removable cover or lid, which can be rigid/hard or soft (e.g., a tarp), and can prevent debris from entering the spa when not in use. Rigid spa covers can further provide safety features, for example, inhibiting access to the water and preventing young children from falling in while unattended. Spa covers can also provide insulation to retain heat between uses.

Thus, a hard spa cover typically has sufficient strength and rigidity to provide protection against hazards when the cover is in place. For example, a hard cover may have sufficient strength to handle the weight of moderate loads such as snow or small animals. Such hard spa covers can be relatively lightweight and preferably provides a high degree of thermal insulation as well as hazard protection.

For example, it is often desirable for spa covers to meet the ASTM F1346 performance specifications for safety covers. This standard specifies, inter alia, the minimum static load that a spa cover can support and the maximum edge deflection under such static load. The current version of this standard is ASTM F1346-91, and it is also used by UL (formerly Underwriters Laboratories) as its certification criteria for Manual Safety Covers under UL Product Category Code WBAH. The ASTM F1346-91 standard specifies, in part:

7.1 Static Load—In the case of a pool with a width or diameter greater than 8 ft (2.4 m) from the periphery, the cover shall be able to hold a weight of 485 lb (220.0 kg) (2 adults and 1 child) to permit a rescue operation.

7.1.1 In the case of a pool with a width or diameter not greater than 8 ft (2.4 m) the cover shall withstand the weight of 275 lb (125 kg) (weight of a child and an adult). Compliance shall be determined by the test method described in 9.1.

7.2 Perimeter Deflection—The cover shall be designed in such a way that, when it is tested by the test method described in 9.2, deflection of the cover does not allow the test object to pass between the cover and the side of the pool, or to gain access to the water.

Such performance standards can provide a safer spa cover. Test methods to measure conformance of a particular spa cover to these and other standards are detailed in Section 9 of the ASTM F1346-91 standard. Thus, conformance of a spa cover with these ASTM standards can be determined directly per the specified procedure, with little or no experimentation.

A conventional two-panel insulating hard spa cover 100 is illustrated in FIGS. 1A-1C. The top view shown in FIG. 1A includes two large sections 110 joined by a central flexible hinge 120. Each section 110 includes a "pocket" formed by a sturdy outer layer 130, which may be a heavy vinyl or similar material, as also shown in the cross-sectional side view of FIG. 1B. Each pocket contains a single continuous, rigid foam panel 140. The outer layer 130 on the underside of the spa cover 110 may be made of a different material than the upper side because it is not directly exposed to the outside environment when in use. The hinge 120 can be made of the same material as the outer layer 130, optionally with extra reinforcement, or it can be made of a different material. In some covers, the hinge 120 shown connecting two sides of a cover 100 in FIG. 1A, may be omitted entirely such that the two or more sections 110 simply butt up to and against each other. A flap of material, or "skirt" 150, can be provided around the perimeter of the spa cover 100. Often one or more keyed safety locks are provided to fasten the cover 100 to the sides of the spa for increased safety, and to prevent unwanted removal of the spa cover 100.

The panels 140 are typically made of a rigid foam, such as (EPS) or the like. Such materials can provide both structural rigidity and insulation for the spa. The thickness of the panels 140 is typically between about 2 inches and 6 inches thick, and may be tapered as shown in FIG. 1B. Such taper can promote drainage or runoff of water or debris when the spa cover 100 is placed on a spa, e.g., to better conform to Section 7.3 of the ASTM F1346-91 standard, which specifies surface drainage properties of a cover.

When placed on a spa, the edges of the spa cover 100 and internal panels 140 are supported only by the top rim at the outer perimeter of the spa. For example, in the spa cover 100 shown in FIG. 1A, each panel 140 is supported only on three sides when the cover 100 is placed on a spa. The fourth side of each panel 140, e.g., the side proximal to the hinge 120, is only supported at each end. Accordingly, as shown in FIG. 1C, a rigid support beam 160 is often provided along the edge of the panels 140 that are proximal to the hinge 120. This support beam 160 can have the cross-sectional shape of the letter C (referred to herein as a "C-beam"), and can be inserted into pre-cut slits 165 along the central edge of the panel 140. The support beam 160 can be made of a rigid material such as galvanized steel, and can provide additional structural support for the central region of the spa cover 100. Slight variations in the features of the spa cover 100 are also known, such as the use of an overlying flap made from the same material as the outer layer 130 to cover a gap between the pockets and panels 140, instead of an attaching hinge 120.

The water in a spa is typically treated with chemicals such as chlorine for sanitation and is usually heated for comfort. Such warm, chlorinated, wet environment can be corrosive or damaging to the foam panels 140 (which may become waterlogged) and the metal C-shaped support beam 160 (which may rust, corrode, or otherwise degrade). Accordingly, a vapor barrier (not shown) is often provided around the panels 140 and the support beams 160, inside the outer layer 130. Such vapor barrier can be made of a heavy plastic sheeting or the like, and can prevent or reduce exposure of the panels 140 and support beams 160 to the warm, wet, chlorinated environment.

Spas come in many shapes and sizes. A typical spa can be roughly square in shape, and about 7-8 feet across in each direction. The typical spa cover design with a flexible central hinge 120 will have a smaller overall size when folded as compared to a single rigid panel that covers the entire spa, and thus can facilitate shipping, removal and storage of the spa cover 100. However, a typical folded spa cover is still about 8 feet long by 4 feet wide, which is still quite large.

The shipping costs for such large packages can be expensive and impact the economics of providing spa covers to customers.

For example, in U.S. Pat. No. 5,367,722 to Pesterfield, an inflatable spa cover is described that includes two sealed air-tight enclosures connected by a hinge, with flexible internal braces that form multiple chambers within each enclosure, and 2 rigid support beams inserted into a pocket provided along either side of the hinge. However, such air-filled covers, although compact when uninflated, must be inflated for use and must maintain air pressure over time (where pressure could be lost through a minor leak along any seam or in the cover material itself). Such inflatable covers are also at risk for catastrophic failure due to, e.g., puncture, slicing, or failure of a seam.

U.S. Pat. No. 5,685,031 to Watkins et al. ("Watkins") describes a rigid spa cover that is made up of two or three interlocking pieces, where each piece is formed of a molded plastic outer shell filled with foam material for insulation. Although each of the pieces in the 3-piece version may be smaller than each of the two sections 110 of the spa cover 100 (illustrated in FIGS. 1A-1C) for the same size of spa, this 3-piece cover has several disadvantages over the more common type of spa cover 100. For example, when placed on a spa, one side of the spa cover 100 can be folded over the other side along the hinge 120, to provide access to the spa (which is often done for just one or two users) without requiring removal of the entire cover 100. Further, many spa owners use a cover "lifter" that includes a bar that passes under the hinge 120 and facilitates lifting and removal of the cover 100. Such assisted removal is not possible with the spa cover of Watkins, where each rigid section of the cover must be removed manually, and such sections may be too heavy to lift for some users. The vinyl cover material 130 in the spa cover 100 can remain flexible over a broad range of temperatures, whereas the molded plastic shell of the cover in Watkins is more likely to become brittle and possible crack when used in colder climates. Also, any exterior fading, scrapes, cuts, etc. on the spa cover 100 can be easily repaired with a patch or by replacement of just the outer vinyl material 130. In contrast, superficial damage to the molded cover of Watkins would require replacement of the entire damaged piece. Additionally, thermal insulation is an important feature of spa covers in addition to safety. The spa cover of Watkins requires the internal foam to be specifically shaped to match the contours of the outer shell, which is a labor-intensive process. Or, if foam pellets are used inside the shell as described, such pellets would provide inferior thermal insulation as compared to the solid foam panels 140 in FIGS. 1A-1C. Most importantly, spa covers must be made to precisely fit particular spa models to ensure a good fit, proper safety, adequate insulation properties, etc. There are thousands of spa and hot tub models on the market, with different shapes and sizes. However, the molded cover of Watkins must be designed to fit only a single model of spa or hot tub, and making a mold for the outer plastic shell is both costly and time-consuming. In contrast, spa covers 100 having the general structure illustrated in FIGS. 1A-1C can be adapted to fit almost any size and shape of spa using the same basic materials (e.g., foam panels 140 and an outer layer 130), merely by altering the size and shape of both of these components. Such alteration is easy to do based on the measured spa dimensions, as it requires merely cutting the shapes of the foam panels 140 and vinyl outer layer 130 appropriately. Thus, the spa cover of Watkins would be prohibitively expensive for any first- or third-party manufacturer of spa covers who wants to provide spa covers for a variety of different spas and hot tubs.

Conventional rigid spa covers requires large boxes or cartons for packaging and shipping, and shipping costs for such large boxes can be expensive and impact the profitability of making and selling such covers. Also, such large boxes may not fit in a typical vehicle if transported by an individual. Accordingly, it is desirable to provide a spa cover that can be easily manufactured for a range of different spa models, can be packaged and/or shipped in relatively small boxes as compared to conventional spa covers, but still be sufficiently rigid to perform effectively and optionally meet certain safety standards.

SUMMARY OF EXEMPLARY EMBODIMENTS

Exemplary embodiments of the disclosure provide spa covers that can be shipped and optionally packaged for long-term storage in smaller containers or boxes than conventional spa covers. The disclosed spa covers include an outer layer that forms one or more pockets, where each pocket contains a plurality of rigid panels and a support structure to provide overall rigidity and support to the cover. The outer layer can be made from one or more materials that include a heavy vinyl sheet or similar material that is preferably flexible.

Accordingly, the disclosed spa cover can be similar to the spa cover 100 shown in FIGS. 1A-1B and described herein above, except that each single panel in the prior-art cover 100 is replaced by a panel assembly that includes a plurality of rigid panels and a support structure. The panels are typically made of a rigid foam such as EPS, and the support structures can be provided in any of several configurations and made of one or more appropriate structural materials as described herein. Properties of the spa cover components as described herein can be selected such that the resulting spa cover conforms to the static load, perimeter deflection, and/or other performance requirements of the ASTM F1346 standard.

In one embodiment, each pocket contains a panel assembly that includes three panels and a support structure that includes a large beam having a C-shaped cross-section (a "C-beam"). The panels can each have approximately the same width, as or alternatively the widths of the panels may be different. The C-beam can be placed over the central edge of the adjacent panels, and may be sized such that it remains in place by friction and/or by the surrounding outer layer.

The C-beam can be made of any sufficiently rigid material such as e.g., stainless or galvanized steel, or nonmetallic structural materials such as, e.g., fiberglass, plastic, composite materials, or the like. Such materials can be used to form any of the various support structures described herein. Each panel can be encased in a vapor barrier film, and the C-beam can be placed on the outside of the vapor barrier film. In further embodiments, the C-beam can be placed directly onto the panels and the vapor barrier film placed over the entire assembly that includes the panels and C-beam.

In certain embodiments, the C-beam can be provided in two or more segments, where the segments are coupled by hinges that span at least a portion of the central face of the C-beam. In still further embodiments, the C-beam can be provided as two or more segments that can be fastened and/or coupled to one another using conventional fasteners such as, e.g., nuts and bolts, screw-type fasteners, molded or externally-applied clips, interlocking features, or the like.

The ends of the C-beam segments may optionally be shaped to overlap when fastened together to provide further structural strength.

In a further embodiment, the support structure for the panel assembly includes a plurality of separate C-beams, where a continuous section of a C-beam spans each gap between adjacent panels. Smaller C-beams can be inserted into at least a portion of one or more edges of one or more of the panels (e.g., into slits provided in the ends of the foam panels), for additional support and load distribution.

In another exemplary embodiment, the support structure for the panel assembly includes an I-beam provided between adjacent panels at or proximal to the central or "free" edge of the panels that is not supported by the spa rim when the cover is in use.

In a still further embodiment, the support structure can include I-beams that extend between adjacent panels from near the outer edge to near the central edge of the panel assembly. C-shaped support beams can optionally be provided along the central edge of the panels. In further embodiments, any embodiment of the panel assemblies described herein can further include I-beams provided between adjacent panels to improve the strength and rigidity of the panel assemblies.

In yet another embodiment, the support structure can include an L-beam that is located underneath and along the central edge of the panels and extends substantially to the ends of the panel assembly. The L-beam can be provided as a single segment. In another embodiment, the L-beam can be provided as a plurality of adjacent or overlapping segments that can be coupled or fastened together using clips, screw-type fasteners, adhesives, clamps, hinges, or the like.

In still further embodiments, the number of panels in each panel assembly can be varied. For example, panel assemblies containing two panels, three panels, or four or more panels can also be used, with the sizes and components of the support structures adapted accordingly.

In yet another embodiment, the support structure for a panel assembly can further include an upside-down T-beam placed between adjacent panels to provide additional structural support. This T-beam can extend from at or near an outer edge of the panel assembly to at or near the central edge thereof, such that it is supported by the rim of the spa and by any central support structure described in the other embodiments herein.

In further embodiments of the disclosure, each panel assembly can include a plurality of "lengthwise" panels that extend from one side of the spa perimeter to the opposite side, and a support structure that includes upside-down T-beams placed between adjacent panels such that both ends of the T-beams are supported directly by the rim of a spa when the cover is placed on the spa. An L-beam support can optionally be provided along the bottom of the "free" end of the centermost panel to provide further support to the cover 100.

In another embodiment of the disclosure, the spa cover can include a first component made of an outer layer that forms two pockets connected by a flexible hinge, and a second cover component that includes at least a third pocket made from another portion of an outer layer, with each pocket containing a panel assembly according to any of the embodiments described herein. One component can be provided with a flap along the edge adjacent to the other component, such that the flap covers the gap between the two components. This flap can be secured to the top of the adjacent cover component using, e.g., a hook-and-loop fastener, a zipper, or the like.

In further embodiments of the disclosure, a spa cover can be provided that is made from a plurality of pockets of the outer layer that are not attached by a hinge, where each pocket contains a panel assembly according to any of the embodiment described herein. A flap of material can be provided between each pair of adjacent pockets in such configuration to cover the gap between them.

Other embodiments, features, and advantages of the present disclosure are provided in the specification herein.

BRIEF DESCRIPTION OF THE DRAWINGS

Further objects, features and advantages of the disclosure will become apparent from the following detailed description taken in conjunction with the accompanying figures showing illustrative examples, results and/or features of the exemplary embodiments of the present disclosure, in which:

FIG. 6B is a perspective view of the panel assembly shown in FIG. 6A with one type of support structure;

FIG. 6C is an end view of the panel assembly shown in FIGS. 6A and 6B; and FIG. 6D is an end view of the panel assembly shown in FIG. 6A with a further type of support structure.

Figure 1A:
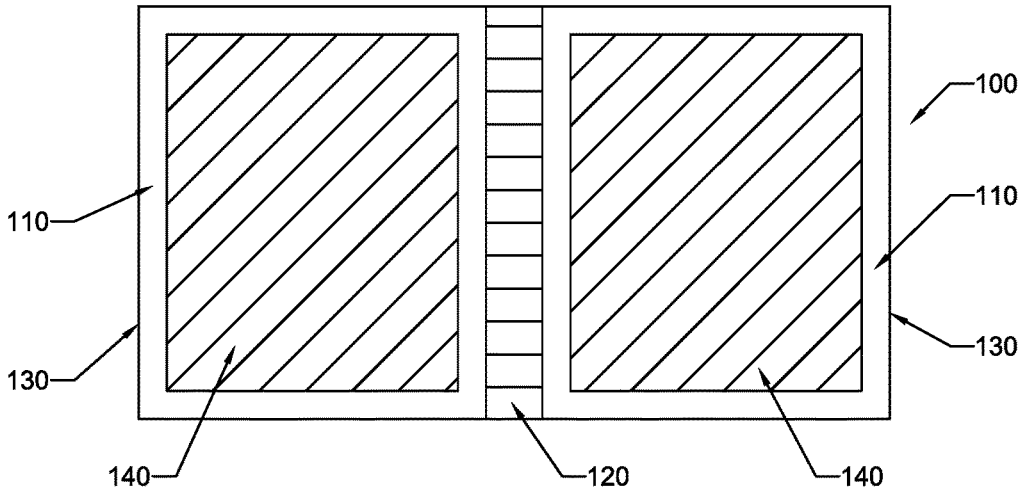
FIG. 1A PRIOR ART
FIG. 1A is a top view of a conventional rigid/hard spa cover.

The various embodiments of the disclosure are described herein with reference to the figures, where like reference numbers indicate identical or functionally similar elements. Further features and advantages of the disclosure as well as the structure and operation of various embodiments of the present disclosure are described in detail below with reference to the accompanying drawings. To the extent that the present disclosure does reference the figures, it is done so in connection with the illustrative embodiments and is not limited by the particular embodiments illustrated in the figures. It is intended that changes and modifications can be made to the described embodiments without departing from the true scope and spirit of the present disclosure.

DETAILED DESCRIPTION OF EXEMPLARY EMBODIMENTS

Exemplary embodiments of the disclosure provide rigid spa covers that can be shipped and optionally packaged for long-term storage in smaller containers or boxes than conventional spa covers. The disclosed spa covers include an outer layer 130 that forms one or more pockets, where each pocket contains a plurality of rigid panels 140 and a support structure to provide overall rigidity and support to the cover. Accordingly, the disclosed spa cover can be similar to the spa cover 100 shown in FIGS. 1A-1B and described herein above, except that each single panel 140 in the prior-art cover 100 is replaced by a panel assembly that includes a plurality of rigid panels 140 and a support structure.

The outer layer 130 can be made from one or more materials that include a heavy vinyl sheet or similar material that can be flexible. Such flexibility can facilitate assembly of the spa cover components, and also allow the outer layer 130 to be folded easily for shipment and/or storage. Each pocket formed by the outer layer 130 is preferably sized so that it conforms closely to the shape and outer surface of the enclosed panel assembly. Such shape conformance can reduce or eliminate relative motion of components of the panel assembly, and thus contribute to the stability of the overall spa cover. A close-fitting outer layer 130 can also result in a smoother appearance of the cover with no apparent wrinkles in the outer layer 130.

The panels are typically made of a rigid foam such as EPS, and the support structures can be provided in any of several configurations and made of one or more appropriate structural materials as described herein. In some embodiments, sizes, shapes, and/or materials of components of the cover (e.g., panels and support structures) can be selected such that the resulting cover has a strength equal to or greater than a cover that contains a single rigid panel per pocket, such as the prior-art cover illustrated in FIG. 1A. In further embodiments, properties of the spa cover components as described herein can be selected such that the resulting spa cover conforms to the static load, perimeter deflection, and/or other performance requirements of the ASTM F1346 standard.

Figure 2A:
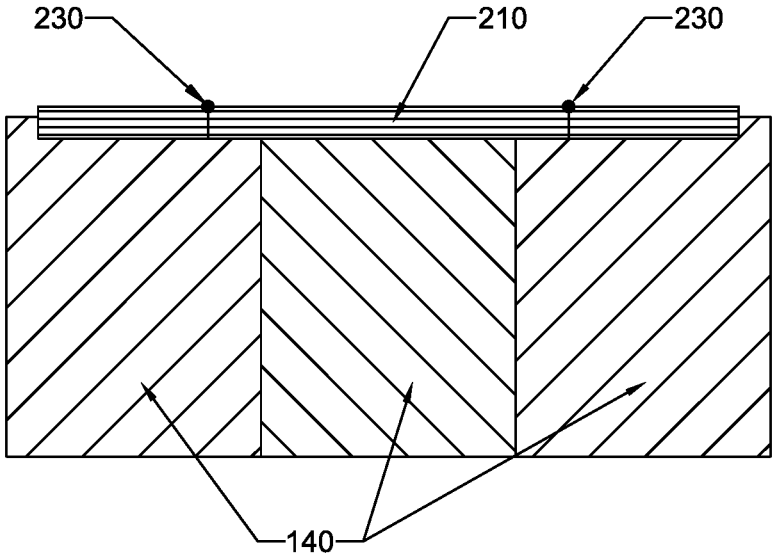
FIG. 2A is a top view of a panel assembly that can be used in a spa cover in accordance with one embodiment of the disclosure.
Figure 2B:
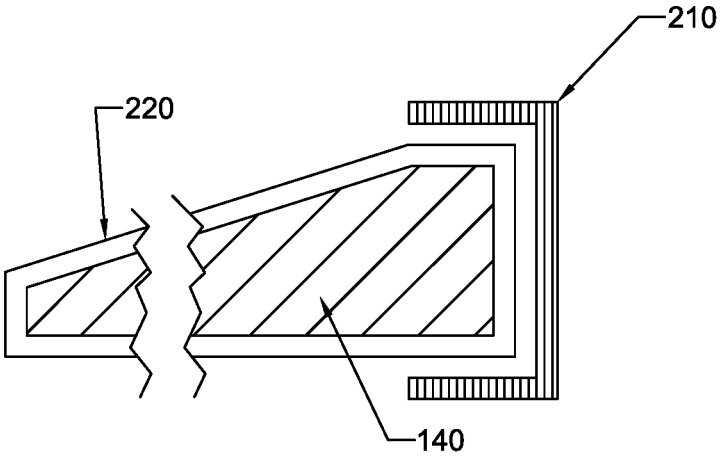
FIG. 2B is a cross-sectional view of a portion of the panel assembly shown in FIG. 2A.
Figure 2C:
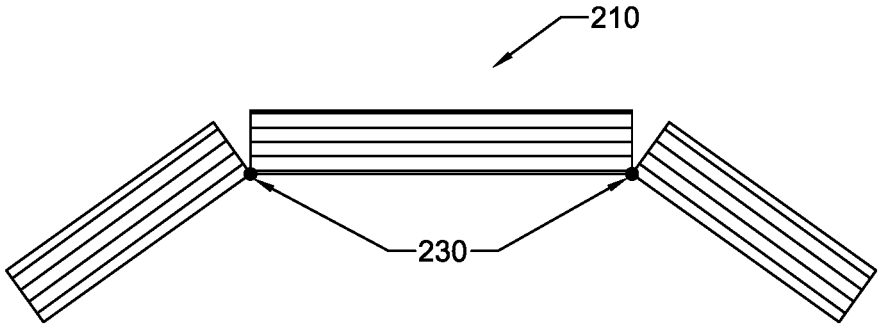
FIG. 2C illustrates a support structure element for the panel assembly shown in FIG. 2A.

In one embodiment, shown in FIGS. 2A-2C, a single panel 140 from the cover shown in FIG. 1A is replaced by a panel assembly that includes three panels 140 and a support structure that includes a large beam 210 having a C-shaped cross-section (a "C-beam"). The panels 140 can each have approximately the same width, as illustrated in the top view of FIG. 2A. Alternatively, in a further embodiment, the widths of the panels 140 may be different. The C-beam 210 can be placed over the central edge of the adjacent panels 140, and is preferably sized so that it can remain in place by friction, and may also be held in place by the outer layer 130. An assembly of three panels 140 and the support structure C-beam 210 can then be placed within each pocket of the outer layer 130, e.g., in a configuration similar to that shown in FIG. 1A, to form a spa cover 100 in accordance with embodiments of the present disclosure. The edge of the panel assembly containing the support structure 210 can be placed along the central hinge 120 to provide improved support along the center of the spa cover 100. If the panels 140 are tapered, as shown in the side view of FIG. 2B, the central edge can be notched or trimmed to provide parallel surfaces at this edge to facilitate placement of the C-beam 210 over this edge of the panels 140. Additionally, the bottom edge of the panel 140 can optionally be provided with a notch or cutout (not illustrated) such that the bottom surface of the C-beam 210 is flush with the bottom surface of the panel 140 when the C-beam 210 is placed over the edge of the panel 140. A tight fit of the C-beam 210 over the edge of the panels 140 can provide further support and stability to the resulting panel assembly by inhibiting relative motion of the panels 140.

The C-beam 210 can be made of any sufficiently rigid material such as e.g., stainless or galvanized steel, or non-metallic structural materials such as, e.g., fiberglass, plastic, composite materials, or the like. Such materials can be used to form any of the various support structures described herein. Non-metallic materials can be preferable because they are less likely to corrode or degrade in the spa or hot tub environment, where the air is often warm, very humid, and may contain chlorine or other chemicals used as disinfectants in the spa water. Each panel 140 can be encased in a vapor barrier film 220, and the C-beam 210 can be placed on the outside of the vapor barrier film 220, as shown in FIG. 2B. Here, "sufficiently rigid" can mean capable of sustaining applied loads placed on the cover without undue bowing or deformation of the cover when placed on a spa, where appropriate loads and desired deformation limits can be obtained, e.g., from certain standards such as the ASTM F134 performance specifications identified herein above, such that the criterion of "sufficiently rigid" can be determined for any performance requirements without undue experimentation.

In further embodiments, e.g., if the C-beam 210 is made of metal or another material subject to corrosion, the C-beam 210 can be placed directly onto the panels 140 and the vapor barrier film 220 placed over the entire assembly that includes the panels 140 and C-beam 210. For example, the vapor barrier film 220 can be provided as an appropriately-sized flexible plastic pouch where the open end can be closed or sealed after the assembly of panels 140 and C-beam 210 are inserted. One or more edges of the vapor barrier film 220 can be sealed, e.g., using a "ziplock"-type mechanism, by folding the open edges over several times and fixing the folded edge with tape or adhesive, or by any other known method or fastener that can provide an air-tight seal for the vapor barrier film 220. Similar considerations and options apply to other forms of the support structure described in the various embodiments herein.

In another embodiment, a waterproof or water-resistant coating can be applied over at least a portion of the surface of the rigid panels 140, e.g., instead of or in addition to use of a vapor barrier film 220, to reduce or inhibit any effects of the wet spa environment on the panels 140.

Figure 1B:
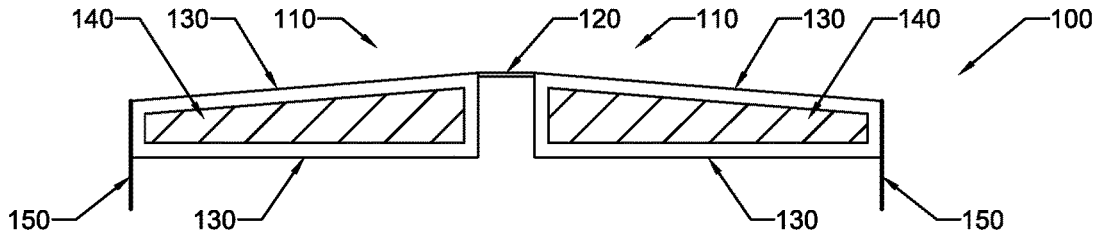
FIG. 1B PRIOR ART
FIG. 1B is a cross-sectional view of the conventional spa cover shown in FIG. 1A.

In a further embodiment, the C-beam 210 can optionally be shaped or angled such that the top flange tapers downward to conform to the slope of a tapered panel 140, such as the edge of the panel 140 closest to the hinge 120 in FIG. 1B. Such angled C-beam 210 can be slid over the tapered end of a panel 140 from the side during assembly of a panel assembly. The shape of the angled C-beam 210 can prevent it from being pulled off the end of the tapered panel 140, and provide still further stability to the panel assembly.

The C-beam 210 in any of the embodiments described herein can be provided in multiple segments to reduce its maximum dimension. Such reduced size can provide advantages with respect to usage of smaller shipping boxes and/or more compact storage as compared to a single rigid structure that is as long as the full width of the spa cover 100. For example, in one embodiment shown in FIGS. 2A and 2C, the C-beam 210 can be provided as three segments, where the segments are coupled by hinges 230 that span at least a portion of the central face of the C-beam 210. This exemplary support structure can be folded or disassembled to facilitate compact shipping and storage, and easily unfolded to be placed along the edge of the panels 140, thereby assembling a panel structure for use in the spa cover 100. In another embodiment (not illustrated), the C-beam support structure 210 can be provided as two segments that are coupled by a single hinge 230. The two segments can be approximately the same length, such that the hinge 230 is located at or near the center of the panel assembly. In further embodiments, the C-beam support structure 210 can be provided with other numbers of segments, with at least some of the segments coupled by hinges 230. However, because the hinges 230 may be less strong than the continuous C-beam 210, it may be preferable to have 2 or 3 segments coupled by 1 or 2 hinges, respectively. Such configurations can provide a rigid support structure that is sufficiently small when the components of the panel assembly are disassembled and the C-beam support structure is folded.

The side edges of the panels 140 can be spanned by a continuous segment of the C-beam 210, such that the locations where the segments of the C-beam 210 are joined together are located away from the gaps between adjacent panels 140 as illustrated, e.g., in FIG. 2A. Such configuration can provide increased mechanical support of the panels 140 along the central edge of the cover. The panels 140 can provide additional mechanical support between segments of the C-beam 210, to improve overall rigidity and strength of the assembly. The ends of the C-beam 210 can extend substantially to the ends of the panel assembly shown in FIG. 2A, e.g., to the ends of the panel assembly or sufficiently close thereto such that the ends of the C-beam 210 will rest on and be supported directly by the rim of the spa when the spa cover 100 is placed on the spa. The rim of a typical spa is usually between about 3 inches and 8 inches wide.

In further embodiments, the C-beam 210 can be provided as two or more segments that can be fastened to one another using conventional fasteners such as, e.g., nuts and bolts, screw-type fasteners, molded or externally-applied clips, or the like. In a further embodiment, end portions of the segments can be provided with interlocking features such as, e.g., tapered tabs and holes, or slots and tabs, that can be fitted together to join the adjacent segments securely. Such fastening configurations may be used to join or couple segments of any of the various beam types described herein. The ends of the C-beam segments may optionally be shaped to overlap when fastened together to provide further structural strength. In this manner, a supporting structure can be provided that can be shipped and stored in smaller containers than a single full-length support, and still provide sufficient rigidity and strength to the overall spa cover 100 when assembled.

Although the multiple segments of a C-beam 210 provided as described above can be smaller than a single continuous length of a C-beam 210, a one-piece beam may provide better structural rigidity in some embodiments. Similar considerations apply to other components of the support structure for different embodiments including, e.g., L-beams 410 and/or T-beams 510 as described herein. Further, such relatively narrow beams may still be inexpensive to ship and easy to store, as compared to the single large conventional panels 140 shown in FIG. 1A. Accordingly, benefits of the present invention may be realized even if a part of the support structure is long compared to the size of the individual panels 140 in a panel assembly as described herein.

Figure 1C:
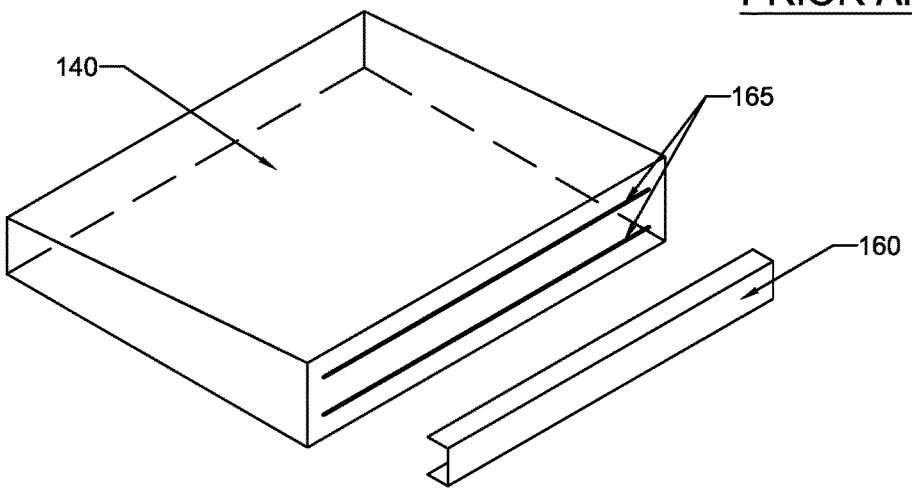
FIG. 1C illustrates a structural foam panel and attached support element for the conventional spa cover shown in FIG. 1A.
Figure 3A:
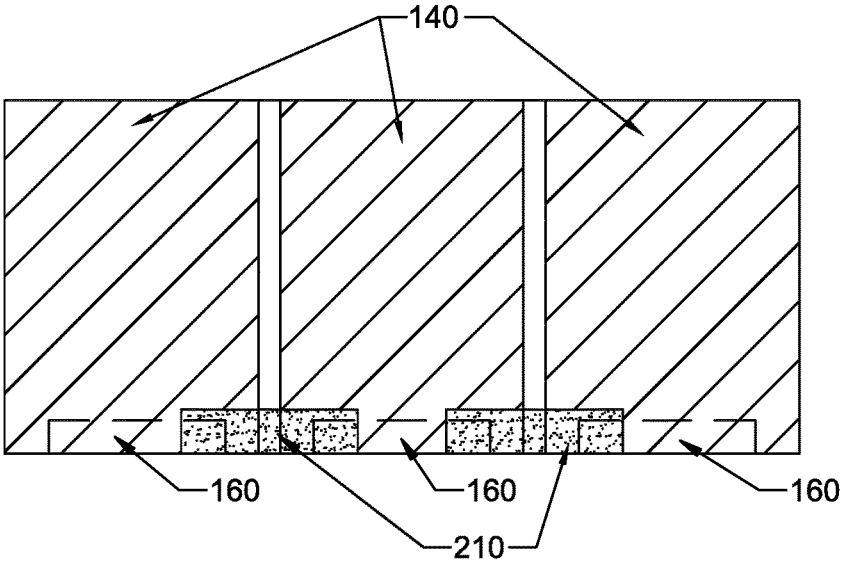
FIG. 3A is a top view of a panel assembly that can be used in a spa cover in accordance with a further embodiment of the disclosure.

In a further embodiment, shown in FIG. 3A, the support structure for the panel assembly includes a plurality of separate C-beams 210, similar to those shown in FIG. 2B, provided over a portion of the "free" edge of the panels 140. Optionally, smaller C-beams 160 can be inserted along at least a portion of this edge of the panels 140 (e.g., into slits 165 provided in the ends of the foam panels 140), similar to those shown in FIG. 1C, for additional support and load distribution. The C-beams 210 and optional small C-beams 160 are preferably sized such that a C-beam 210 spans the location where adjacent panels 140 abut, and overlaps at least a portion of the smaller C-beams 160 (if present) in the adjacent panels 140. Further, either or both of the C-beams 160, 210 on the endmost panels 140 can be sized such that at least a portion of the C-beam 160, 210 will be located over (or proximal to) the rim of the spa when the cover is placed on the spa (e.g., such that they extend to within a few inches of the ends of the panels 140). Smaller C-beams 160 can optionally be inserted along at least a portion of side edges of the panels 140 in any of the embodiments described herein to provide additional support and structural rigidity to the panel assemblies.

Figure 3B:
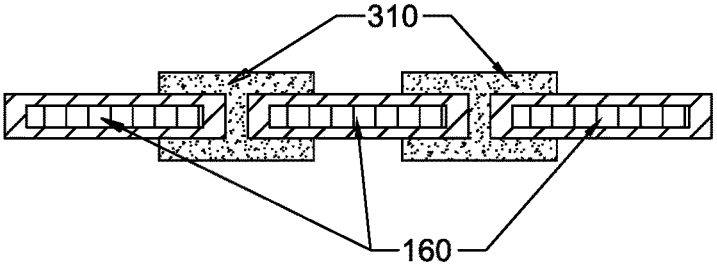
FIG. 3B is an end view of the panel assembly shown in FIG. 3A.

In another exemplary embodiment, shown in FIG. 3B, the support structure for the panel assembly includes an I-beam 310 provided between adjacent panels 140 at or proximal to the "free" edge of the panels 140, and optionally includes smaller C-beams 160 inserted into the edge of the panels 140 as shown in FIG. 3A. The I-beams 310 can be made of, e.g., fiberglass, composite materials, metal (such as galvanized steel or the like), or other structural materials. The width and length of the I-beams 310 can be selected based on the strength of the material used to form them to provide a desired level of structural support, without undue experimentation. The I-beams are preferably sufficiently long and wide, e.g., at least 2-3 inches in each direction, to distribute any load supported by the I-beams 310 over a sufficient area of the adjacent panels 140 to inhibit or prevent local deformation or failure. These I-beams 310 can be several inches wide, similar to the width of the C-beams 210 shown in the top view in FIG. 3A. The combination of the C-shaped support beams 160 with the I-beams 310 can provide sufficient support and distribution of any load supported by the spa cover 100 to result in an overall rigid spa cover, e.g., one that can meet the ASTM safety cover standards described herein.

Figure 3C:
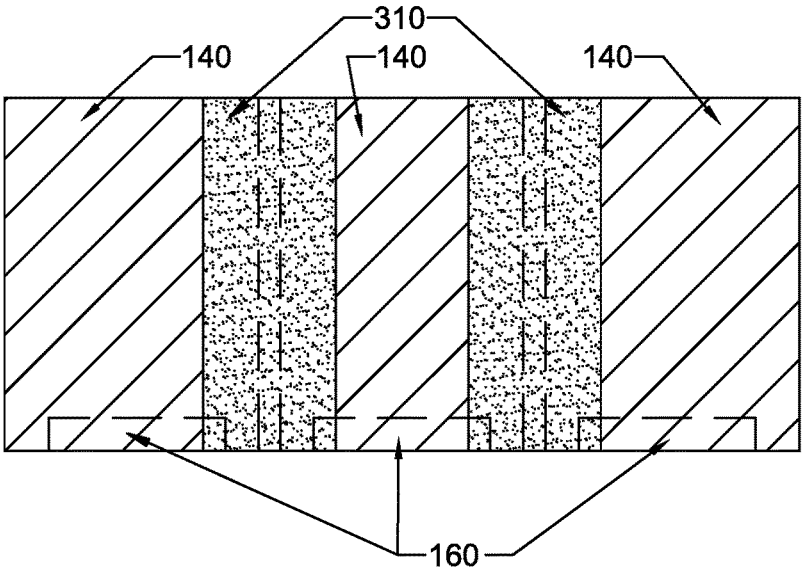
FIG. 3C is a top view of the panel assembly shown in FIG. 3A that includes a further embodiment of a support structure.

In a still further embodiment, the support structure can include I-beams 310 that extend between the panels 140 from near the outer edge to near the central edge of the panel assembly, as shown in the top view of FIG. 3C. This configuration allows one end of the I-beams 310 to be supported directly by the rim of the spa when the spa cover 100 is in use. Again, the width of such I-beams 310 can be selected based on the material used to make them to provide sufficient structural support without undue experimentation. C-shaped support beams 160 can again be optionally provided along the central edge of the panels 140, as shown in FIG. 3C, to provide additional structural rigidity and strength to the panel assembly. If the sides of the foam panels 140 are tapered, then a tapered I-beam 310 can be provided to conform to the side profile of the panel 140. Alternatively, an I-beam 310 can be provided having uniform height, and a longitudinal recess or notch can be cut into the side of each panel 140 such that the side of each panel 140 fits into the I-beam recess (preferably with a snug fit to retain the I-beam 310 in place via friction). Additionally, the bottom edge of the panel 140 can optionally be provided with a notch or cutout (not illustrated) such that the bottom surface of the I-beam 310 is flush with the bottom surface of the panel 140 when the I-beam 310 is placed over the edge of the panel 140.

In further embodiments, I-beams 310 can be provided between panels 140 with any of the various embodiments described herein to improve the strength and rigidity of the panel assemblies and of the overall spa cover 100. Such I-beams 310 can extend substantially to the outer edge of the panel assembly so they can be supported directly by the rim of the spa, and can extend to substantially the center edge of the panel assembly to overlap or connect to any further support components located along this central edge and provide improved support and load distribution. Such I-beams 310 in the support structure provide the advantage of inhibiting relative motion of the adjacent panels 140 in any direction when the I-beams 310 are configured to have a snug fit over the panel edges.

Figure 4A:
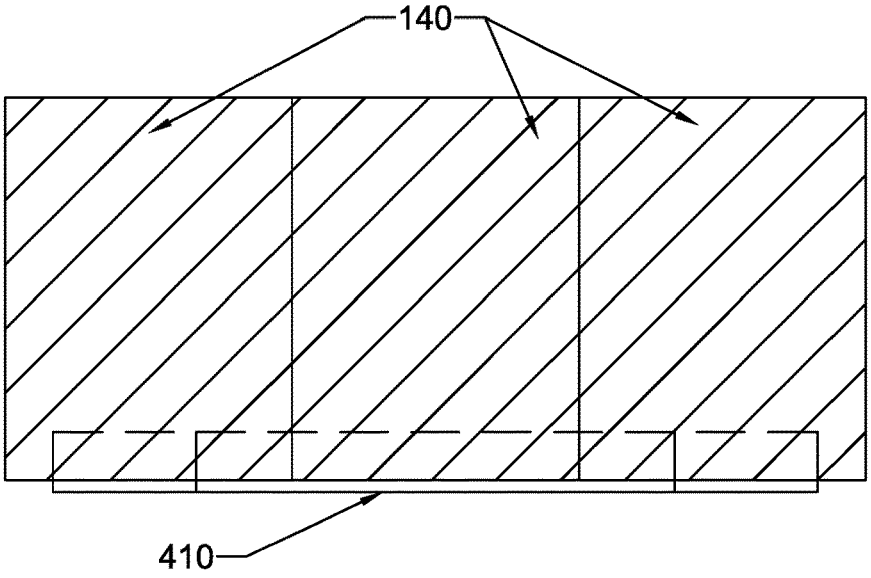
FIG. 4A is a top view of a panel assembly that can be used in a spa cover in accordance with another embodiment of the disclosure.
Figure 4B:
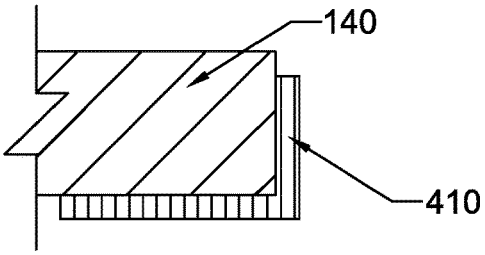
FIG. 4B is a side view of a portion of the panel assembly shown in FIG. 4A.

In yet another embodiment, the support structure can be provided as an L-beam 410 that is located underneath and along the central edge of the panels 140, as shown in FIGS. 4A-4B. The top view of FIG. 4A shows the L-beam 410 extending substantially to the ends of the panel assembly, such that it can be supported directly by the rim of the spa when in use. FIG. 4B illustrates a side view of the central end of a foam panel 140 shown in FIG. 4A, illustrating how the L-beam 410 provides a supporting surface beneath the foam panel 140. Similar to the supporting C-beam 210 shown in FIGS. 2A-2C, the L-beam 410 can be provided in a plurality of segments that can be connected to one another to form a continuous support. For example, the L-beam 410 can be provided as a plurality of adjacent or overlapping segments (e.g., 2, 3 or more segments) that can be coupled or fastened together using clips, screw-type fasteners, adhesives, clamps, hinges 230, or the like. As with the other embodiments described herein, C-shaped support beams 160 can be embedded in one or more edges of one or more panels 140, similar to the configuration shown in FIG. 1C, to provide further support. Additionally, the bottom edge of the panel 140 can optionally be provided with a notch or cutout (not illustrated) such that the bottom surface of the L-beam 410 is flush with the bottom surface of the panel 140 when the L-beam 410 is placed over the edge of the panel 140. Such L-beams 410 in the support structure provide the advantage of being able to support any size or shape of the panels 140 regardless of panel thickness or taper.

In still further embodiments, the number of panels 140 in each panel assembly can be varied. For example, although the main embodiments have been described herein using three panels 140 in each panel assembly of the spa cover 100, panel assemblies containing two panels 140, or containing 4 or more panels 140, can also be used, with the sizes and components of the support structures adapted accordingly. Fewer panels 140 can improve strength of the spa cover 100 while requiring fewer support structure components, whereas spa covers 100 containing a greater number of panels 140 can be shipped/stored in more compact packages. Accordingly, a particular number of panels 140 per panel assembly can be selected based on consideration of these factors. In general, panel assemblies containing three panels 140 may be preferable, with 2-panel assemblies being a possible choice, e.g., for smaller spas. Panel assemblies containing more than 4 panels can be provided but may not be desirable because of the reduced intrinsic strength resulting from the separated panels 140 and the increased number of support structure components needed.

As noted previously, a vapor barrier film 220 can be provided around each panel 140 (and an embedded C-shaped support beam 160, if present) of a panel assembly, and components of the support structure can be fastened to the outside of such enclosed panels 140 to form a panel assembly. In further embodiments, the panels 140 and support structure can be fully assembled and then placed within a sealable vapor barrier film 220. In either variation, the entire panel assembly with vapor barrier film 220 can then be placed in each pocket of the outer layer 130 to form the spa cover 100.

Figure 5:
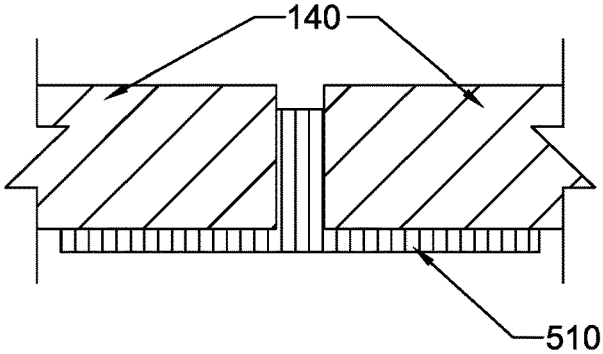
FIG. 5 is a side view of a support structure for a panel assembly in accordance with yet another embodiment of the disclosure.

In yet another embodiment, an upside-down T-beam 510 can be placed between adjacent panels 140 to provide additional structural support, as shown in FIG. 5. This T-beam 510 can extend from at or near an outer edge of the panel assembly to at or near the central edge thereof, similar to the placement of the I-beam 310 illustrated in FIG. 3C. In this manner, the ends of the T-beam 510 can be supported by the rim of the spa and by any central support structure described herein (e.g., the embodiments shown in FIGS. 2-4), and provide additional strength to the panel assemblies. For example, a T-beam 510 can be provided between two adjacent panels 140, where an L-beam 410 is provided along one end of the panel assembly as shown, e.g., in FIG. 4A. In this manner, the end of the panel assembly not supported directly by the rim of the spa is supported by the L-beam 410, where the ends of the L-beam 410 are supported by the rim of the spa. The ends of each T-beam 510 can then be supported directly by either the L-Beam 410 or the rim of the spa, and the T-beam 510 can inhibit relative vertical movement of adjacent panels 140 and provide additional support to the sides of the panels 140. A C-beam 210 can optionally be provided instead of the L-beam 410 in a similar configuration.

Such T-beams 510 in the support structure provide the advantage of being able to support any size or shape of the panels 140 regardless of panel thickness or taper, and of maintaining vertical alignment of adjacent panels 140. In further embodiments, the bottom edge of the panel 140 can optionally be provided with a notch or cutout (not illustrated) such that the bottom surface of the T-beam 510 is flush with the bottom surface of the panel 140 when the T-beam 510 is placed over the edge of the panel 140.

Figure 6A:
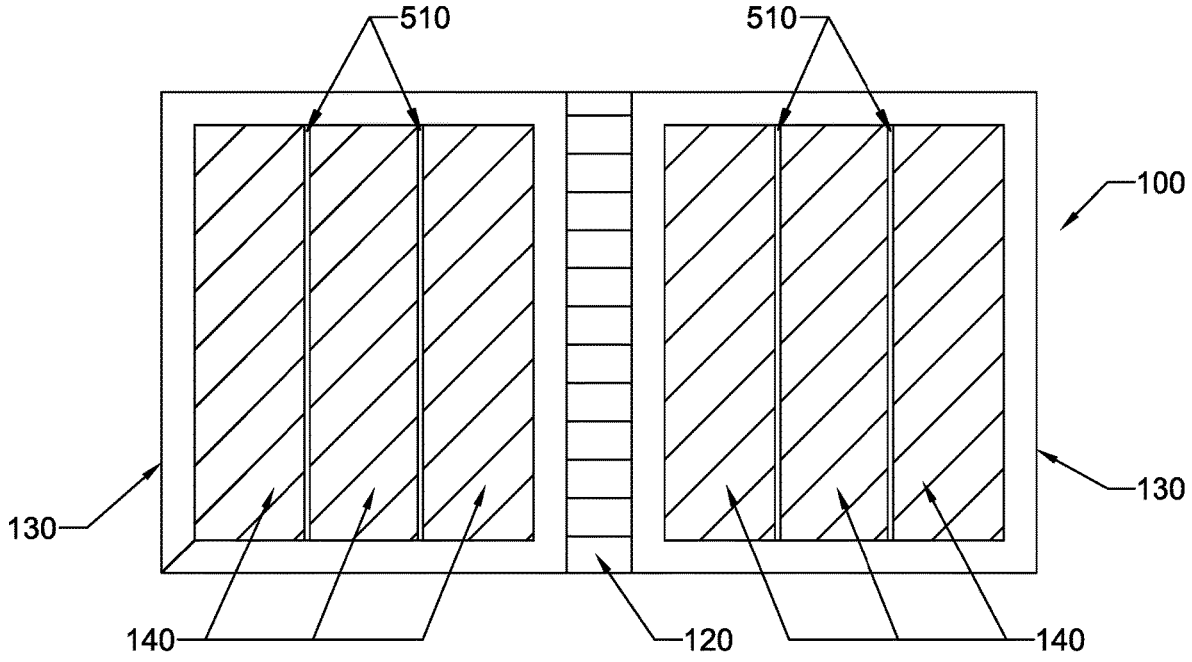
FIG. 6A is a top view of a further embodiment of a panel assembly where the individual panels have a different orientation.

In an alternate embodiment of the disclosure, each panel assembly can include a plurality of panels 140 that extend from one side of the spa rim or perimeter to the opposite side, as shown in FIGS. 6A-6B. A support structure that includes upside-down T-Beams 510 placed between adjacent panels 140 can be provided. These T-beams 510 preferably span the length of the panels 140, such that the ends of the T-beams 510 are supported directly by the rim of a spa when the cover 100 is placed on the spa. The width, height, thickness, and material of the T-beams 510 can be selected to provide sufficient rigidity to each panel assembly and to the overall cover 100. An L-beam support 410, similar to that shown in FIGS. 4A and 4B, can optionally be provided along the "free" end of the centermost panel 140 (e.g., as shown in FIG. 6C) to provide further support to the cover 100.

In another "lengthwise" panel configuration, illustrated in FIG. 6D, the support structure can include I-beams 310 instead of the T-beams 510 shown in FIGS. 6A-6C. The I-beams can be shaped to conform to the slope of the tapered panels 140. Alternatively, notches or bevels can be provided in the ends of the panels 140 such that they fit snugly into the recesses of the I-beams. The I-beams 310 may provide more stability and further reduction of relative movement of adjacent panels 140 as compared to the T-beams 510.

The "lengthwise" panel assemblies shown in FIGS. 6A-6D may be desirable when narrower shipping boxes or storage spaces are preferred, and reducing the length of such boxes or spaces is not as important.

In another embodiment of the disclosure, the spa cover 100 can include a first component made of an outer layer 130 that forms two pockets connected by a flexible hinge 120, in a configuration similar to that shown in FIG. 1A, with each pocket containing a panel assembly according to any of the embodiments described herein. However, for larger spas, this component of the cover may not extend across the full width of the spa. Instead, a second cover component that includes a third pocket made from another portion of an outer layer 130, also containing a panel assembly, can be provided as a separate component. This third pocket can be sized to cover the portion of the spa not covered by the two pockets of the first cover component. Each pocket can contain a panel assembly that includes a plurality of panels 140 and any of the various embodiments of the support structures described herein. One component of this two-component cover can be provided with a flap along the edge adjacent to the other component, such that the flap covers the gap between the two components. This flap can be secured to the top of the adjacent cover component using, e.g., a hook-and-loop fastener, a zipper, or the like. In this manner, a larger spa cover can be provided that essentially has three rigid panels, with two of them being connected by a hinge 120, having individual panel sizes comparable to those of a two-pocket spa cover 100 as described herein, but capable of covering a larger spa.

In further embodiments of the disclosure, a spa cover can be provided that is made from a plurality of pockets of the outer layer that are not attached by a hinge 120, where each pocket contains a panel assembly as described herein, which may be formed using a plurality of panels 140 and any embodiment of the supporting structure described herein. In such "multipiece" covers, each side of a panel assembly that extends from one side of the spa to another and is not supported by the rim of the spa along such side can be provided with an appropriate support structure along such "unsupported" side. For example, if a spa cover 100 is provided that includes three unattached pockets with panel assemblies, then the central assembly may have a supporting structure provided along both sides adjacent to the two end pockets, because these sides are not supported along their length by the rim of the spa. A flap of material can be provided between each pair of adjacent pockets in such configuration, as described above.

As described herein, embodiments of the disclosure provide a spa cover 100 that includes an outer layer 130 that forms at least two pockets. A panel assembly that includes at least 2 foam panels 140 and a support structure can be placed within each pocket, to form a spa cover 100 having essentially two large rigid panels that can be connected by a flexible hinge 120, similar to conventional spa covers. A panel assembly as disclosed herein replaces each single panel 140 illustrated in FIG. 1A. As with conventional spa covers, the panel assemblies can be provided with a vapor barrier film 220 that encloses the panels 140 individually or collectively, and optionally also encloses some or all of the components of the support structure.

As with conventional spa covers, the panel assemblies can be inserted into the pockets of the outer layer 130, and the pockets can then be closed or sealed using, e.g., zippers, hook-and-loop fasteners, or the like. In any of the embodiments described herein, the pockets can be sized to fit snugly over the associated panel assemblies when sealed, to maintain better contact between the panels 140 and the support structures and reduce or eliminate movement of the panels 140 within the pockets.

Embodiments of the present disclosure can provide additional benefits beyond smaller component sizes for shipping and/or storage. For example, a vapor barrier film 220 is provided in most spa covers because commonly-used metal support components can corrode if exposed to the warm chlorinated atmosphere above the spa. Also, the foam panels 140 can become waterlogged over time if exposed to moisture. If a single large panel of a conventional cover becomes damaged, it has to be replaced and both shipping and material costs can be significant. In contrast, the smaller panels 140 and/or individual support structure components provided in embodiments of the present disclosure can be replaced individually when damaged, thereby reducing associated material and shipping expense for the owner.

Although the invention has been described in terms of particular embodiments and applications, one of ordinary skill in the art, in light of this teaching, can generate additional embodiments and modifications without departing from the spirit of or exceeding the scope of the claimed invention. For example, specific sizes/dimensions and/or materials used for the components of the disclosed spa covers may be selected to provide desired structural properties without undue experimentation based on the provided disclosure. Accordingly, it is to be understood that the drawings and descriptions herein are proffered by way of example to facilitate comprehension of the invention and should not be construed to limit the scope thereof. Any patents, publications, or other documents cited herein are hereby incorporated by reference in their entireties.

What is claimed is:

1. A cover for a spa, comprising:

an outer layer that forms at least one enclosed pocket; and a rigid panel assembly provided within the at least one enclosed pocket, wherein the rigid panel assembly comprises a plurality of rigid panels and a support structure.

2. The cover of claim 1, wherein each of the plurality of rigid panels is made from expanded polystyrene.

3. The cover of claim 1, wherein the panel assembly and the outer layer are configured such that the cover conforms to the ASTM F1346 standard for static load and perimeter deflection.

4. The cover of claim 1, wherein the support structure comprises at least one C-beam placed over an end portion of at least two adjacent rigid panels.

5. The cover of claim 4, wherein the C-beam is provided as a plurality of beam segments.

6. The cover of claim 5, wherein at least two of the beam segments are coupled to one another using a hinge.

7. The cover of claim 5, wherein at least two of the beam segments are coupled to one another using a fastening arrangement.

8. The cover of claim 4, wherein the support structure further comprises at least one smaller C-beam, and wherein at least a portion of the smaller C-beam is embedded in an end portion of at least one rigid panel.

9. The cover of claim 1, wherein the support structure comprises at least one I-beam located between at least two adjacent rigid panels.

10. The cover of claim 9, wherein the support structure further comprises at least one smaller C-beam, and wherein at least a portion of the smaller C-beam is embedded in at least one side of at least one rigid panel.

11. The cover of claim 1, wherein the support structure comprises at least one L-beam located along an end of at least two adjacent rigid panels, where a length of the L-beam is selected such that at least one end of the L-beam is supported by a rim of the spa when the cover is placed on the spa.

12. The cover of claim 11, wherein the L-beam is provided as a plurality of beam segments, and wherein at least two of the plurality of segments are coupled to one another using at least one of a hinge or a fastening arrangement.

13. The cover of claim 1, wherein the support structure comprises at least one T-beam provided between at least two adjacent rigid panels, where a length of the T-beam is selected such that at least one end of the T-beam is supported by a rim of the spa when the cover is placed on the spa.

14. The cover of claim 1, further comprising a vapor barrier enclosing at least one rigid panel.

15. The cover of claim 14, wherein the vapor barrier further encloses at least a portion of the support structure.

16. The cover of claim 1, wherein the support structure consists of non-metallic materials that comprise at least one of a fiberglass material, a composite material, or a plastic material.

17. The cover of claim 1, wherein:

the cover comprises at least two pockets formed by the outer material;

each pocket contains a panel assembly; and at least two pockets are coupled to one another by a flexible hinge.

18. A cover for a spa, comprising:

an outer layer that forms at least two enclosed pockets; and a panel assembly provided within each pocket of the at least two enclosed pockets, wherein the panel assembly comprises a plurality of rigid panels and a support structure;

wherein each of the plurality of rigid panels is made from expanded polystyrene; and wherein the support structure comprises at least one of a C-beam or an L-beam provided along an end portion of at least two adjacent rigid panels.

19. The cover of claim 18, wherein:

the at least one C-beam or L-beam is provided as a plurality of beam segments; and wherein at least two of the beam segments are coupled to one another using a hinge.

20. The cover of claim 18, wherein the panel assembly and the outer layer are configured such that the cover conforms to the ASTM F1346 standard for static load and perimeter deflection.

* * * * *